US009308617B2

(12) United States Patent
Schneider

(10) Patent No.: US 9,308,617 B2
(45) Date of Patent: Apr. 12, 2016

(54) SECURING STRUCTURE FOR OPTIC DEVICE

(75) Inventor: Steven M. Schneider, Germantown, WI (US)

(73) Assignee: Satisloh North America, Inc., Germantown, WI (US)

( * ) Notice: Subject to any disclaimer, the term of this patent is extended or adjusted under 35 U.S.C. 154(b) by 565 days.

(21) Appl. No.: 13/421,208

(22) Filed: Mar. 15, 2012

(65) Prior Publication Data

US 2012/0238191 A1 Sep. 20, 2012

Related U.S. Application Data

(60) Provisional application No. 61/453,513, filed on Mar. 16, 2011.

(51) Int. Cl.
*B24B 41/06* (2012.01)
*B24B 13/005* (2006.01)

(52) U.S. Cl.
CPC ..... *B24B 13/0052* (2013.01); *B24B 41/062* (2013.01)

(58) Field of Classification Search
CPC ..... B24B 13/0052; B24B 41/062
USPC ..... 451/390, 460, 42, 384; D16/130, 136
See application file for complete search history.

(56) References Cited

U.S. PATENT DOCUMENTS 1,184,496 A * 5/1916 Stenvall ..... 451/384
2,225,193 A 12/1940 Benner et al.
2,573,668 A 10/1951 Long et al.
2,853,925 A 9/1958 Lee
2,861,402 A 11/1958 Okenfuss
2,953,970 A 9/1960 Maynard
3,118,198 A * 1/1964 Prunier ..... 164/98
3,383,808 A * 5/1968 Deshayes et al. ..... 451/390
3,996,701 A 12/1976 Ramirez et al.
4,066,330 A 1/1978 Jones
4,089,102 A * 5/1978 Soper et al. ..... 29/527.5
4,158,273 A * 6/1979 Olsen et al. ..... 451/42
D263,679 S 4/1982 Frieberg
4,358,913 A * 11/1982 Sorrells ..... 451/390
D271,209 S 11/1983 Feinbloom
D272,745 S 2/1984 Feinbloom et al.
RE31,897 E * 5/1985 Johnson ..... 451/42
4,714,232 A * 12/1987 Blot ..... 249/90
4,733,945 A * 3/1988 Bacich ..... 359/820
4,844,606 A 7/1989 Smith (Continued)

OTHER PUBLICATIONS

Practical Systems Inc. Blocking Supplies product page, Blocking Supplies As Easy as 1-2-3, Dec. 2006.

(Continued)

*Primary Examiner* — Joseph J Hail
*Assistant Examiner* — Marc Carlson
(74) *Attorney, Agent, or Firm* — Whyte Hirschboeck Dudek S.C.

(57) ABSTRACT

A securing structure for an optical piece is disclosed and which comprises: a hub portion; a surrounding portion connected to the hub portion; a plurality of recess structures formed or otherwise provided in at least one of the hub portion and the surrounding portion and which are at least partially open on at least one side; and a rib structure that at least partially separates the plurality of recess structures. The structure is capable of use with an apparatus for securing and clamping optical lenses (e.g., spectacle lenses) requiring edge-machining.

37 Claims, 11 Drawing Sheets

(56) References Cited

U.S. PATENT DOCUMENTS

| | | | | | |
|---|---|---|---|---|---|
| 4,867,563 | A | | 9/1989 | Wurm et al. | |
| 4,915,663 | A | | 4/1990 | Magers | |
| 4,951,349 | A | | 8/1990 | Dietrich et al. | |
| 5,011,274 | A | | 4/1991 | Wagner | |
| 5,069,586 | A | | 12/1991 | Casey | |
| 5,177,907 | A | | 1/1993 | Rothe et al. | |
| D334,880 | S | | 4/1993 | Davey | |
| 5,249,082 | A | | 9/1993 | Newman | |
| 5,455,711 | A | | 10/1995 | Palmer | |
| 5,462,475 | A | * | 10/1995 | Kennedy | 451/384 |
| 5,466,106 | A | * | 11/1995 | Bone et al. | 411/433 |
| 5,474,489 | A | * | 12/1995 | Vernon | 451/42 |
| 5,496,209 | A | | 3/1996 | Gaebe | |
| 5,565,937 | A | | 10/1996 | Lee | |
| 5,619,770 | A | * | 4/1997 | Bell | 15/230.17 |
| 5,627,610 | A | | 5/1997 | Marui et al. | |
| 5,638,147 | A | | 6/1997 | Wang-Lee | |
| 5,649,856 | A | * | 7/1997 | Cook | 451/460 |
| 5,669,807 | A | * | 9/1997 | Moreau et al. | 451/460 |
| 5,748,281 | A | | 5/1998 | Simioni et al. | |
| 5,760,867 | A | | 6/1998 | Pernicka et al. | |
| 5,916,017 | A | * | 6/1999 | Sedlock | 451/460 |
| 6,074,290 | A | * | 6/2000 | Ko et al. | 451/390 |
| 6,163,926 | A | | 12/2000 | Watanabe | |
| D443,811 | S | | 6/2001 | Tisbo | |
| 6,400,516 | B1 | | 6/2002 | Spinali | |
| 6,467,902 | B2 | | 10/2002 | Wang-Lee | |
| 6,641,466 | B2 | * | 11/2003 | Wallendorf et al. | 451/285 |
| 6,645,058 | B2 | | 11/2003 | Puzio et al. | |
| 6,742,891 | B2 | | 6/2004 | Chen | |
| 7,066,797 | B2 | * | 6/2006 | Volken et al. | 451/390 |
| D524,911 | S | | 7/2006 | Thompson et al. | |
| 7,121,931 | B2 | * | 10/2006 | Katzman et al. | 451/57 |
| 7,147,550 | B2 | | 12/2006 | Chen | |
| 7,309,278 | B2 | * | 12/2007 | Shibata | 451/384 |
| 7,500,908 | B2 | * | 3/2009 | Achy et al. | 451/390 |
| D666,228 | S | * | 8/2012 | Schneider | D16/130 |
| D666,229 | S | * | 8/2012 | Schneider | D16/130 |
| D666,230 | S | * | 8/2012 | Schneider | D16/130 |
| D666,231 | S | * | 8/2012 | Schneider | D16/130 |
| D672,799 | S | * | 12/2012 | Schneider | D16/130 |
| D673,198 | S | * | 12/2012 | Schneider | D16/130 |
| D673,597 | S | * | 1/2013 | Schneider | D16/130 |
| D673,598 | S | * | 1/2013 | Schneider | D16/130 |
| 8,460,069 | B2 | * | 6/2013 | Annaka | 451/384 |
| 2002/0149862 | A1 | * | 10/2002 | Wallendorf et al. | 359/808 |

OTHER PUBLICATIONS

Solid-Center Edging Blocks product description page, retrieved from internet url: http://precisiontooltech.com/store/products/solid-center-edging-blocks/, printed on Jul. 23, 2015.

Looktopsi.com, Surfacing and Finishing Supplies and Equipment for Optical Labs, Edging Blocks product page, retreived from internet url: http://looktopsi.com/psi/product-category/finishing/edging-blocks/, printed on Jul. 23, 2015.

DAC Vision Product Guide for Finishing Products brochure, retrieved from internet url: http://www.dacvision.com/downloads/DVNA%20Finishing%20Catalog.pdf, printed on Jul. 23, 2015.

DAC VisionEdging Blocks Products List, retrieved from wayback machine internet url: https://web.archive.org/web/20150413080933/http://store.dacvision.com/business/category/, printed on Aug. 5, 2015.

Precision Tool Technologies, Inc., Product Category: Finishing Department, retrieved from wayback machine internet url: https://web.archive.org/web/20121020070438/http://precisiontooltech.com/store/products/, printed on Aug. 5, 2015.

* cited by examiner

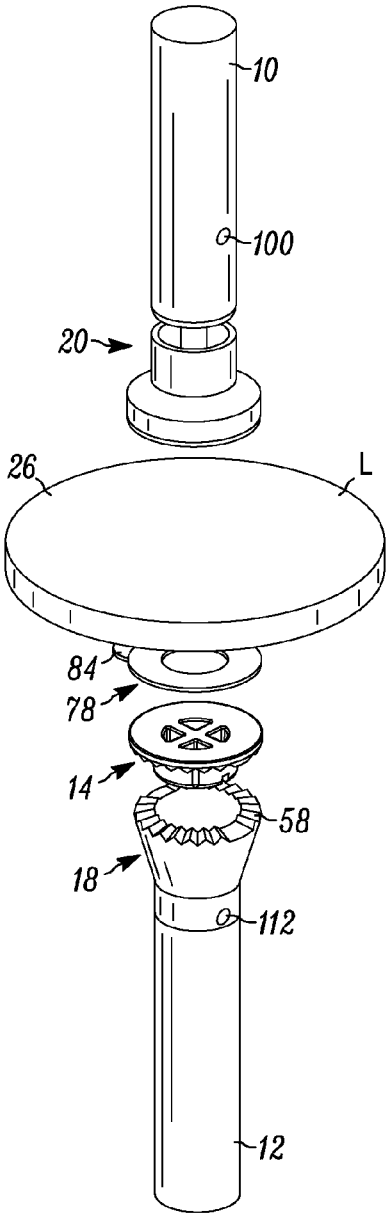
FIG. 1
FIG. 2
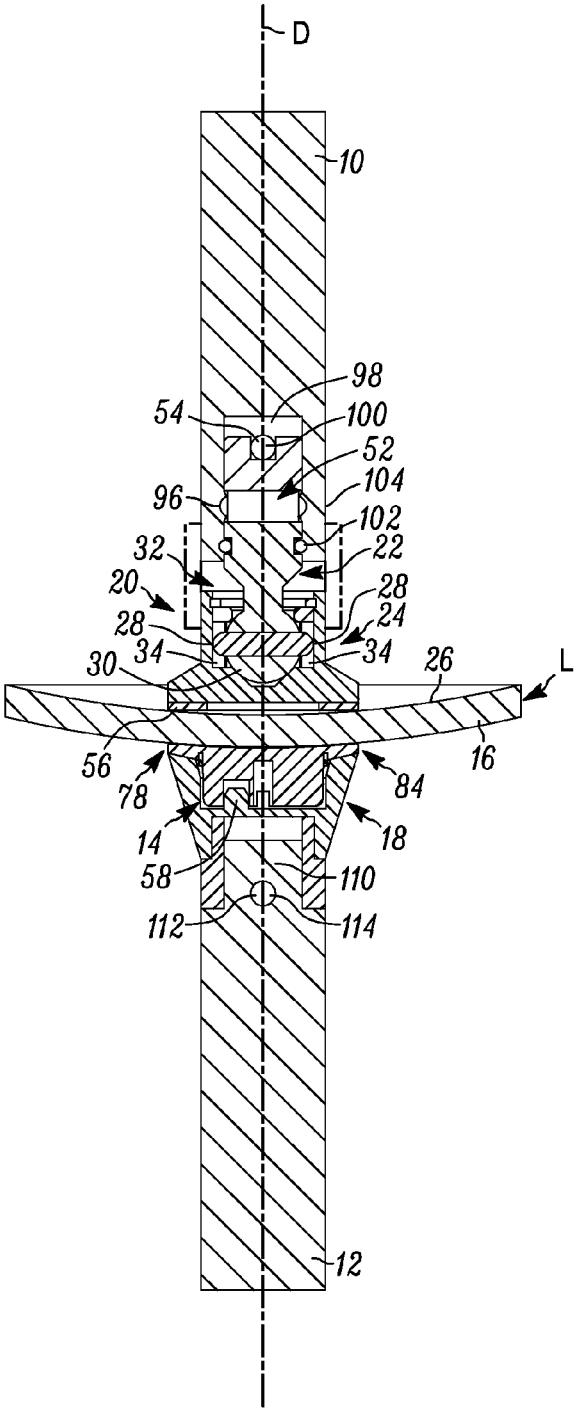

FIG. 4
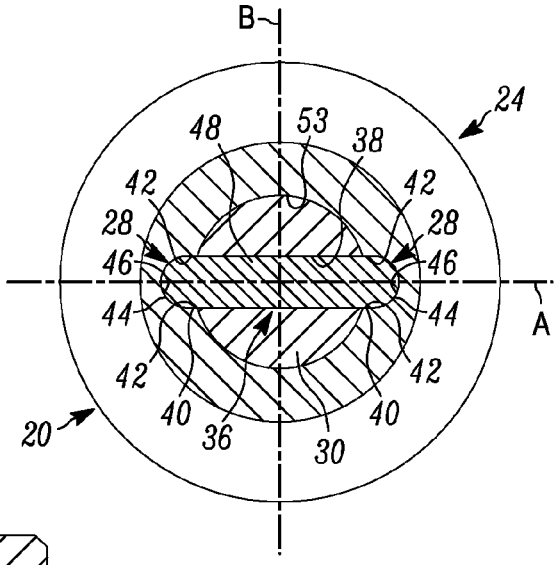
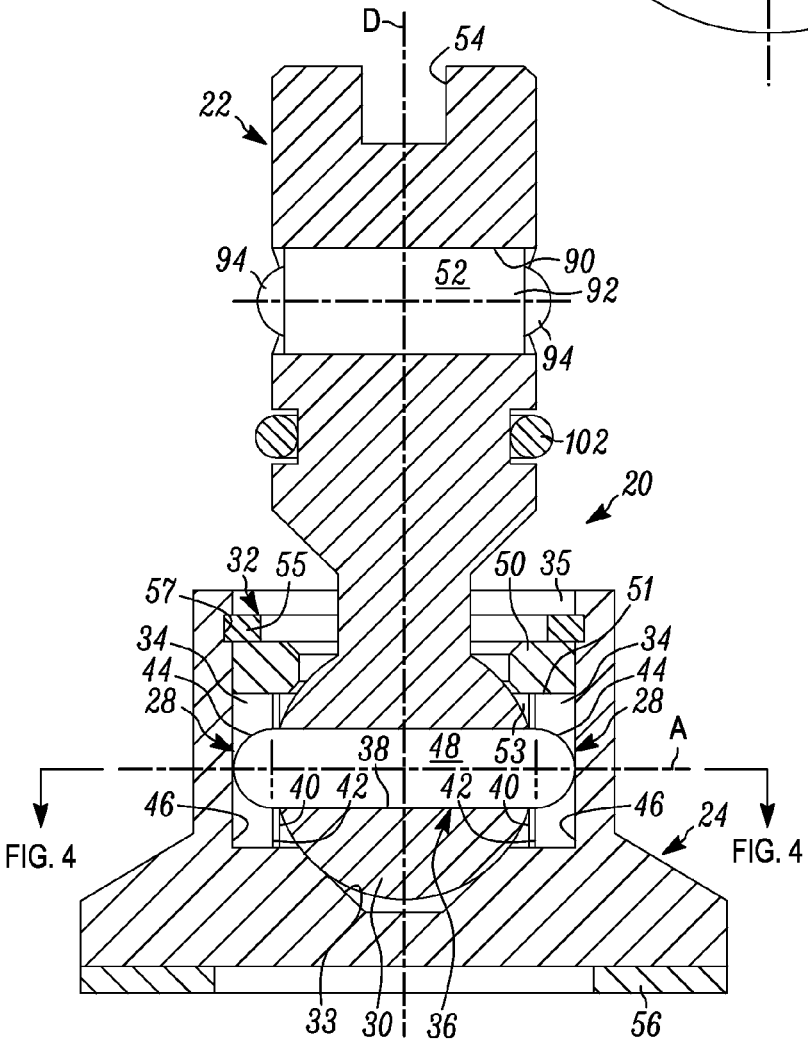
FIG. 3

SECURING STRUCTURE FOR OPTIC DEVICE

RELATED APPLICATIONS

This application claims the benefit of U.S. provisional patent application No. 61/453,513, which was filed on Mar. 16, 2011 and entitled "Securing Structure for Optic Device", and which is hereby incorporated by reference herein in its entirety.

FIELD OF THE INVENTION

The invention relates to a securing structure, and more particularly to a securing structure for use in and/or with an apparatus for optical pieces requiring edge-machining, for instance optical lenses, including spectacle lenses.

BACKGROUND

One purpose of optic piece (e.g., lens) edge-machining is to finish an edge of the piece. For example, a spectacle lens is typically finished in such a way that the lens may be inserted into a spectacle frame. Various arrangements or systems are known which serve to mount the lens for edge-machining and to clamp or otherwise secure it between rotatable holding shafts of a lens edge-machining machine. As used herein, spectacle lenses can mean optical lenses or lens blanks for spectacles made of the usual materials, such as polycarbonate, inorganic glass, CR-39, HI-Index etc., and with circumferential edges of any shape, which lenses or lens blanks may be, but do not have to be, machined on one or both optically effective surfaces prior to machining of the edge thereof.

Lens edge finishing systems can comprise, among other structures, a securing structure (also frequently termed a "block" or "blocking member"), which may be attached detachably to one side of the lens; an adapter for the securing or blocking structure, which may be connected rigidly to one of the holding shafts of the lens edge-machining machine and can be constructed for rotation angle-oriented rotary drive of the securing or blocking structure; and a clamping assembly, which can comprise a fastening portion, connectable rigidly to the other holding shaft of the lens edge-machining machine, and a clamping portion which can be connected to the fastening portion, and which clamping portion can be constructed for force-locking engagement with the other side of the lens. The securing structure can be attached to the optical lens by means of an adhesive film portion or pad which can include adhesive on both sides.

To date, securing structures have suffered from or been susceptible to various drawbacks. For instance, an amount of air may enter between the lens being finished or machined, which can result in reduced bonding or adhesion between the lens and the securing structure. Reduced bonding, in turn, can tend to result in some amount of shifting and/or rotation of the lens (e.g., relative to the securing structure or overall finishing assembly) during a machining operation.

It would be desirable to provide a new securing structure that overcomes the aforementioned and other drawbacks. Further, it would be desirable to provide a new securing structure that can be manufactured in a cost-effective manner.

SUMMARY

In accordance with one aspect of the present disclosure, disclosed herein is a securing structure for an optical piece comprising: a hub portion; a surrounding portion connected to the hub portion; a plurality of recess structures formed or otherwise provided in at least one of the hub portion and the surrounding portion and which are at least partially open on at least one side; and a rib structure that at least partially separates the plurality of recess structures.

Other embodiments, aspects, features, objectives and advantages of the present disclosure will be understood and appreciated upon a full reading of the detailed description and the claims that follow.

BRIEF DESCRIPTION OF THE DRAWINGS

Embodiments are disclosed with reference to the accompanying drawings and are for illustrative purposes only. The present disclosure is not limited in its application to the details of construction or the arrangement of the components illustrated in the drawings. The present disclosure encompasses other embodiments and is capable of being practiced or carried out in other various ways. The drawings illustrate a best mode presently contemplated for carrying out the invention. Like reference numerals may be used to indicate like components.

In the drawings:

FIG. 1 is a perspective exploded representation of an apparatus for securing and clamping a lens (e.g., a spectacle lens, an ophthalmic lens, etc.) requiring edge-machining, which representation shows, from the bottom upwards, a securing structure adapter mounted on a schematically illustrated lower holding shaft, a securing structure, an adhesive film portion, the lens (e.g., a spectacle lens) and a clamping assembly mounted on a schematically illustrated upper holding shaft, taken together and each individually in accordance with at least some embodiments of the present disclosure;

FIG. 2 is a sectional view of the arrangement shown in FIG. 1 in a functional or operational position in accordance with at least some embodiments of the present disclosure;

FIG. 3 is a sectional view of the clamping assembly according to FIG. 2 on an enlarged scale relative to FIG. 2, again in accordance with at least some embodiments of the present disclosure;

FIG. 4 is a sectional view along the section line FIG. 4-FIG. 4 of FIG. 3 on a reduced scale relative to FIG. 3, in accordance with at least some embodiments of the present disclosure;

DETAILED DESCRIPTION

Figure 5:
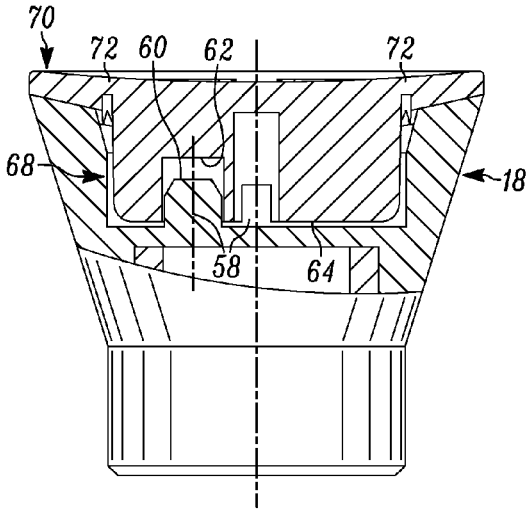
FIG. 5 is a broken-open side view of the securing structure according to FIG. 2 mounted on the securing structure adapter on an enlarged scale relative to FIG. 2, in accordance with at least some embodiments of the present disclosure.
Figure 6A:
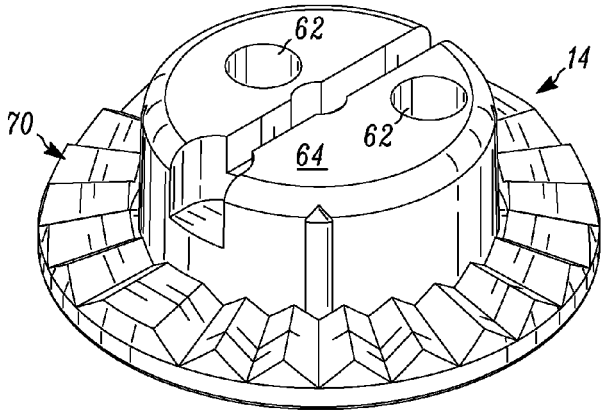
FIGS. 6A-6B are a bottom perspective view and a view from below (or a bottom view), respectively, of the securing structure shown in FIG. 5, and each on a somewhat enlarged scale relative to FIG. 5, in accordance with at least some embodiments of the present disclosure.
Figure 6B:
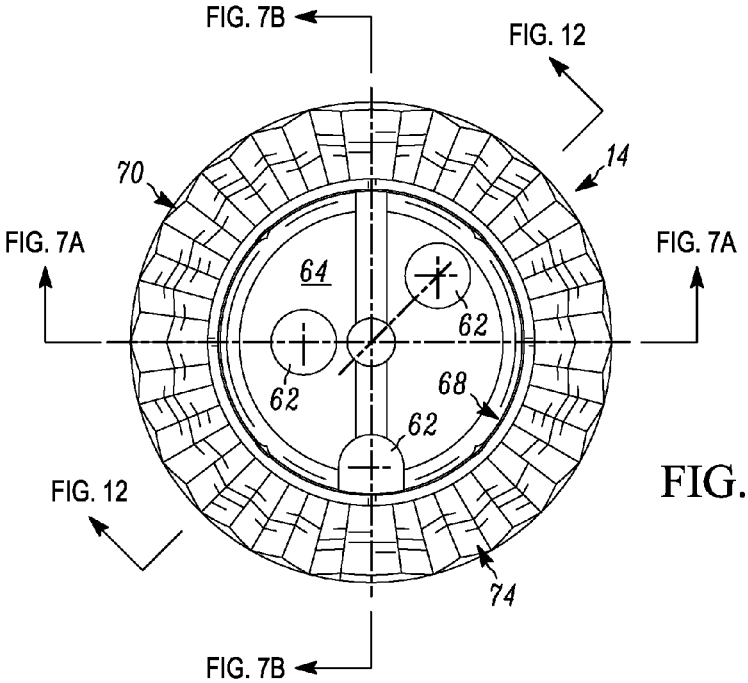

As is revealed by FIGS. 1 and 2, two exemplary rotatably mounted holding shafts 10 and 12 (bearing system not shown) are provided in a vertical functional and machining position on the arrangement for securing and clamping a lens L, such as an optical or spectacle lens, requiring edge-machining. Between the components and elements of and connected to the shafts 10 and 12, which components and elements will be described in more detail herein, there is arranged the lens L. Lens L is clamped, so as to be held, between the holding shafts 10 and 12 is reliably prevented from slipping during edge-machining. Such slippage must not occur, particularly and by way of example, if the lens L is a spectacle lens to be machined and which comprises a close-focus portion aligned in angularly precise manner relative to the optical axis, or a cylindrical or prismatic ground surface, the axial position of which must be in a predetermined relationship to the position of the spectacle lens mounted in the spectacle frame. While a vertical functional and machining position is provided, it is to be understood that other positions and/or orientations, such as horizontal, are contemplated and such orientation disclosed and provided herein is by way of example only.

In accordance with at least some embodiments, lower holding shaft 12 is connected rigidly, non-rotatably and coaxially to securing structure adapter 18, which is constructed in a manner yet to be described for angle of rotation-oriented rotary drive of a securing structure 14, an exemplary embodiment of which is shown, fitted removably to the securing structure adapter 18. The securing structure 14 may be fixed detachably to one side 16 of the lens L. A clamping assembly 20 is fitted coaxially on the upper holding shaft 10 and comprises a fastening portion 22 connectable rigidly to the holding shaft 10 and a clamping portion 24 connected therewith. The clamping portion 24 is constructed for force-locking engagement with the other side 26 of the optical lens L.

In accordance with at least one aspect of the present disclosure, constructing or otherwise providing the clamping assembly, or similar assembly, according to the embodiments of the present disclosure allows very precise, backlash-free (or at least substantially backlash-free) torque transmission together with very smooth angle adjustment. The spherical head mounted in the receiving portion thereof and having two projections allows, in accordance with at least some embodiments, movements superimposed in the manner of a cardan joint about two tilt axes with virtually backlash-free rotary drive by the associated holding shaft due to, at least in part, the engagement between the projections and the channels in the receiving portion. Since the channel bottom of each of the channels displays, in cross section, a shape complementary and dimensionally matching, respectively, to the end zone of the associated projection, form-fitting engagement is obtained between the projections and the channels when viewed with the channel in cross section and the pin in longitudinal section, which form-fitting engagement is advantageous for backlash-free rotary motion transmission between spherical head and receiving portion. The backlash-free torque transmission thus obtained with low wear and at the same time very smooth angle adjustment is a prerequisite for a highly precise edging of spectacle lenses with machinery suitable for industrial production. Precisely aligned orientation relative to the first tilt axis of the two projections of the spherical head may be achieved, for example, by the introduction of a pin, protruding on both sides beyond the spherical head so as to form, for example, projections, into a through-hole which extends with its central axis through the center of the sphere and encloses the pin in play-free manner, In accordance with at least some embodiments, the clamping assembly 20, the details of which are revealed clearly in particular by FIGS. 3 and 4, has a spherical head 30 provided with a projection 28 on each of its opposing sides. As shown, the spherical head 30 is accommodated in a receiving portion 32 and supported at the bottom on a truncated cone-shaped ball bearing surface 33. In some embodiments, this may also take the form of a portion of a spherical surface. The receiving portion 32 is provided with channels 34 extending parallel to the axis of rotation D on opposing sides, which channels 34 serve for substantially rotary play-free guidance of the projections 28. The clamping portion 24 may be swivelled cardanically relative to the fastening portion 22 about a first tilt axis A perpendicular to the axis of rotation D of the spherical head 30 and extending coaxially through the projections 28 and about a second tilt axis B perpendicular to the axis of rotation of the spherical head 30 and to the first tilt axis A. The torque introduced via the holding shaft 10 is transmitted via the projections 28 from the fastening portion 22 to the clamping portion 24.

The projections 28 provided on the spherical head 30 are formed by a pin 36, which extends through a through-hole 38 in the spherical head 30. Each of the two projections 28 provided on the spherical head 30 comprises a cylindrical surface zone 40 protruding out of the through-hole 38. The channels 34 in the receiving portion 32 each have two opposing flat guide surfaces 42, which extend parallel to one another and serve for substantially play-free guidance of the cylindrical surface zones 40 of the projections 28. This guidance is not lost in the event of swivel movements about the second tilt axis B within expected swivel movement limits.

Each of the projections 28 provided on the spherical head 30 comprises an end zone 44, which takes the form of a spherical cap. As is clear from FIG. 4, the channel bottom 46 of each of the two channels 34 provided in the receiving portion 32, when viewed in cross section, displays a shape complementary to the spherical cap-shaped end zone 44 of the associated projection 28. The end zones 44 of the projections 28 have a sphere radius which is identical to the radius of the cross section of the pin 36, i.e. the end zones 44 adjoin the pin 36 continuously, including the cylindrical surface zones 40, In contrast to the exemplary construction shown, the channels 34 may also have a rectangular cross section, wherein the channel width is greater only by a small amount of movement play than the diameter of the cylindrical surface zones 40 of the projections 28. In this instance, the channel side walls form the guide surfaces 42. The sphere radii of the end zones 44 do not have to correspond to the radius of the cylindrical surface zones 40 or the radius of the cross section of the pin 36, but may be greater than these. It has merely to be ensured that the length of the pin 36, measured over the end zones, is smaller by an amount of movement play than the spacing of the channel bottoms of the rectangular channels. The sphere radius of the end zones 44 should be, however, smaller than half the pin length.

The pin 36, in accordance with at least some embodiments of the present disclosure, has a cylindrical basic member 48 forming the cylindrical surface zones 40 of the projections 28. The basic member is provided at both sides with the spherical cap-shaped end zones 44. The pin 36 has a length which is smaller by an amount of movement play than the diametrally measured spacing of the channel bottoms 46. The pin 36 may be accommodated in the through-hole 38 in the spherical head 30 in axially displaceable manner.

The receiving portion 32 for the spherical head 30 is provided on the clamping portion 24 of the clamping assembly 20 in accordance with embodiments of the present disclosure. As is clearest from FIG. 3, the spherical head 30 is held in the receiving portion 32 by means of a two-part retaining ring 50 engaging behind the spherical head 30. The two-part retaining ring rests on an annular shoulder 51, interrupted by the channels 34, of a stepped bore 35 in the receiving portion 32 enclosing the spherical head 30 in its lower area 53 tightly but with movement play (FIG. 4). The two-part retaining ring 50 is in turn held by a snap ring 55, which engages in an annular channel 57 in the stepped bore 35. In the arrangement shown, the spherical head 30 is a component of the fastening portion 22 and is thus in one piece. Other arrangements and embodiments are contemplated and considered within the scope of the present disclosure.

In accordance with embodiments of the present disclosure, the fastening portion 22 of the clamping assembly 20 comprises a locking means 52, by means of which the clamping assembly 20 may be locked detachably to the corresponding holding shaft 10 (FIGS. 2, 3). In the example shown, the locking means 52 is a cylindrical sleeve 92 inserted perpendicularly into a bore 90 in the fastening portion 22, from which locking balls 94 project captively on both sides, which locking balls 94 are loaded divergently by a spring arrangement (not shown) within the cylindrical sleeve 92. The locking balls 94 project beyond the external circumference of the cylindrical fastening portion 22, such that they may be locked together with a locking channel 96 inside a blind bore 98 in the holding shaft 10 accommodating the fastening portion 22 (FIG. 2). Other arrangements and embodiments are contemplated and considered within the scope of the present disclosure.

The fastening portion 22 of the clamping assembly 20 is provided at the end with a channel 54, into which a cross-pin 100 engages for form-fitting rotary drive by the holding shaft 10, which cross-pin 100 is introduced into a transverse bore in the holding shaft 10. This transverse bore passes through diametrically opposing wall areas of the holding shaft 10 defining the blind bore 98. Rotation of the holding shaft 10 is thus transmitted via the cross-pin 100 to the fastening portion 22 and thence via engagement of the projections 28 with the channels 34 to the clamping portion 24.

In accordance with embodiments of the present disclosure, the clamping portion 24 comprises a covering 56 for force-locking engagement with the lens L, which covering 56 is in the shape of a circular ring in the example shown. In at least some embodiments, it consists of or can comprise a material, such as leather or synthetic leather, which is soft in relation to the material of the lens L The covering may be connected with the lower surface of the clamping portion 24 by adhesion. If an injection-moldable polymeric material is used for the covering 56, the latter may also be constructed on its upper side with projections or the like for form-fitting engagement with corresponding recesses or the like in the lower surface of the clamping portion 24 (not shown). In accordance with at least some embodiments of the present disclosure, the covering comprises good adhesive power relative to the optical lens for torque transmission and for the covering not to be capable of causing any damage to the lens surface or thin layers attached thereto, such as anti-reflection coatings.

In accordance with embodiments of the present disclosure, a groove ring seal 102 in the form of an O-ring ensures a seal between the fastening portion 22 and the holding shaft 10. It seals these elements off from one another in the lower area of the blind bore 98. As is indicated by dash-dotted lines in FIG. 2, the holding shaft 10 and the clamping portion 24 may be connected together by a tubular or hose-shaped flexible collar 104. Due at least in part to its flexibility, this collar typically does not prevent cardanic movements of the clamping portion 24 relative to the holding shaft 10, but does at least typically seal the receiving portion 32 effectively against the penetration of contaminants such as grinding dust. In accordance with an aspect of the present disclosure, the collar 104 may have the tendency, especially if it comprises rubber or an elastomeric plastics material, to adopt its extended hollow-cylindrical position, whereby it exerts a pre-centering action on the clamping portion 24 prior to engagement with the lens L.

Securing structure 14, securing structure adapter 18 and their mutual association together with their connection with lower holding shaft 12 are initially described with reference to FIGS. 1 and 2, in conjunction with FIGS. 5 to 9, and in accordance with at least some embodiments of the present disclosure.

For form-fitting rotary drive of the securing structure 14 by the securing structure adapter 18, these components each comprise rotary drive elements, which in accordance with exemplary embodiments are toothed, and which will be described in more detail below. Furthermore, securing structure 14 and securing structure adapter 18 likewise each comprise positioning elements, exemplary embodiments of which are described in more detail below, and which have the task of orienting or positioning securing structure 14 and securing structure adapter 18 correctly relative to one another with regard to angle of rotation prior to engagement of the rotary drive elements.

In accordance with at least some embodiments of the present disclosure, positioning elements comprise a plurality of asymmetrically arranged projections 58 and a plurality of complimentarily associated, correspondingly asymmetrically arranged recesses 62. The projections 58 may either be arranged on the securing structure 14 or on the securing structure adapter 18. The same is true of the recesses 62, i.e. if the projections 58 are located on the securing structure 14, the recesses 62 are arranged on the securing structure adapter 18. If, on the other hand, the projections 58 are arranged on the securing structure adapter 18, the recesses 62 are arranged on the securing structure 14. As illustrated, the projections 58 are constructed or otherwise provided on the securing structure adapter 18, while the recesses 62 are provided on the securing structure 14.

Figure 7A:
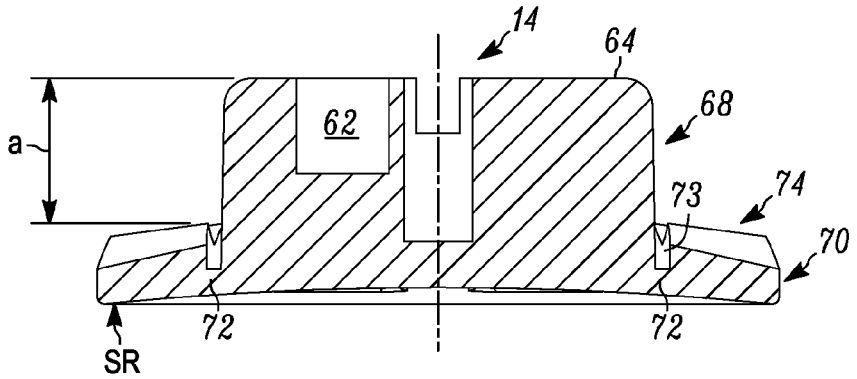
FIGS. 7A-7B are sectional views of the securing structure along section lines FIG. 7A-FIG. 7A and FIG. 7B-FIG. 7B, respectively, in FIG. 6B, and each on a somewhat enlarged scale relative to FIG. 6B, in accordance with at least some embodiments of the present disclosure.
Figure 7B:
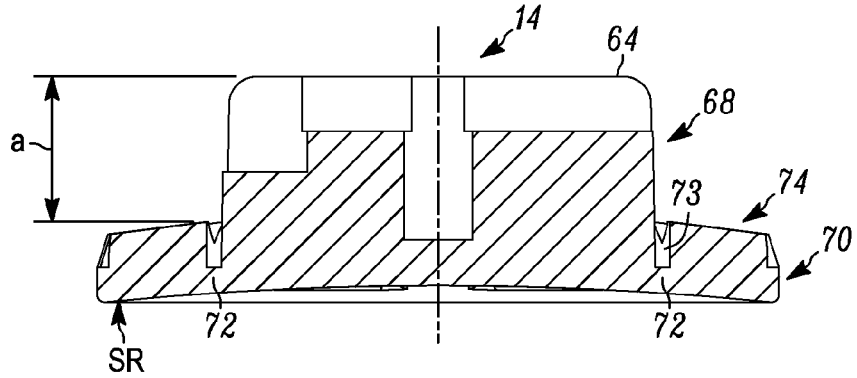
Figure 8:
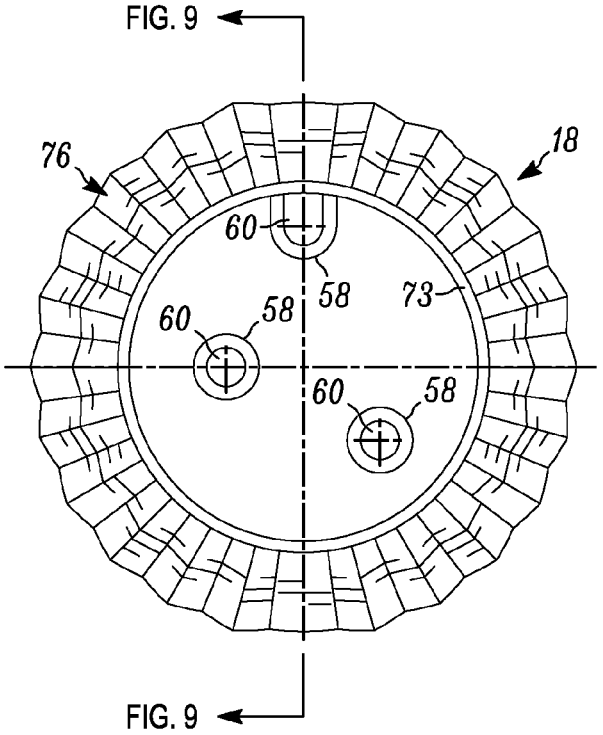
FIG. 8 is a plan view of the securing structure adapter shown in FIG. 5 on a somewhat enlarged scale relative to FIG. 5, in accordance with at least some embodiments of the present disclosure.
Figure 9:
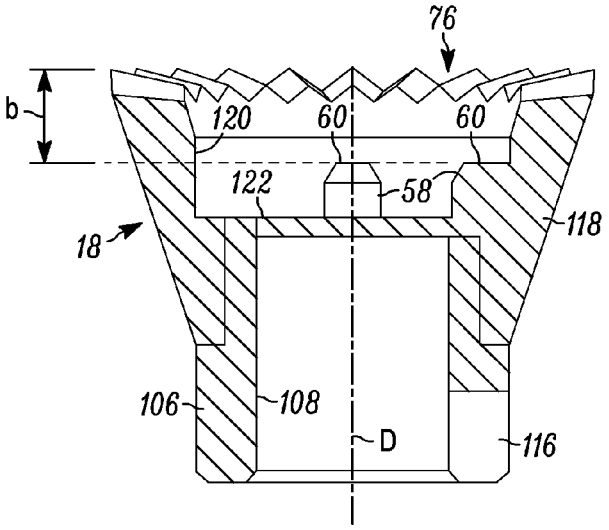
FIG. 9 is a sectional view of the securing structure adapter along section line FIG. 9-FIG. 9 of FIG. 8, rotated by 90 degrees in the clockwise direction in the drawing plane, in accordance with at least some embodiments of the present disclosure.

In accordance with embodiments of the present disclosure, the end faces 60 of the projections 58 lie in a common plane perpendicular to the axis of rotation D (FIGS. 8, 9). The recesses 62 start from a flat surface 64 perpendicular to the axis of rotation D (FIGS. 5, 6, 7). In accordance with at least some embodiments of the present disclosure, the arrangement is such that, at the securing structure 14, the axial distance a (FIG. 7) between the rotary drive elements and the positioning elements, i.e. the flat surface 64 from which the recesses start, is different from, i.e. greater than, the axial distance b (FIG. 9) on the securing structure adapter 18 between the rotary drive elements and the positioning elements, i.e. the common plane of the end faces 60 of the projections 58.

In accordance with embodiments of the present disclosure, the securing structure 14 may be united in the manner indicated below with the securing structure adapter 18 to yield the desired angularly correct engagement situation illustrated in FIG. 5. If the securing structure 14 is moved axially towards the securing structure adapter 18 and orientation with regard to angle of rotation of securing structure and securing structure adapter has not yet been achieved, first of all the projections 58 come to rest with their end faces 60 against the flat surface 64. Then, to affect the sole correct orientation with regard to angle of rotation, the securing structure 14 is turned relative to the securing structure adapter 18, wherein the end faces 60 slide on the flat surface 64 without the securing structure 14 effecting a tilting movement relative to the securing structure adapter 18, which tilting movement could undesirably bring the rotary drive elements partially into engagement. In accordance with at least some embodiments of the present disclosure, due to the matching asymmetrical arrangement of the projections 28 and the recesses 62, typically only one correct rotation angle orientation is possible. If the correct relative rotation angle orientation is achieved between securing structure 14 and securing structure adapter 18, the projections 58 enter the recesses 62 when moved axially closer together, whereupon the rotary drive elements, which are toothed on both sides, finally move into engagement with one another, as shown in FIG. 5, such that torque may be transmitted from the holding shaft 12 to the securing structure 14. Moreover, with such arrangements, the two holding shafts 10 and 12 are driven synchronously at the same speed of rotation.

Further in accordance with at least some embodiments of the present disclosure and to ensure that the end faces 60 lie temporarily in tilt-safe manner against the fiat surface 64, the three projections 58 provided in the exemplary embodiment and naturally also the recesses 62 form the corners of a triangle. However, it must be ensured that the triangle is not equilateral, with the corners thereof at the same radial distance from the axis of rotation, because three different engagement positions displaced by 120 degrees relative to one another would then be possible. The projections and the recesses should be arranged asymmetrically with different radial distances from the axis of rotation.

To simplify introduction of the projections 58 into the recesses 62, the projections 58 and/or the recesses 62 can exhibit or otherwise comprise bezels starting respectively from the end faces 60 of the former or the flat surface 64. Bezels at the inlet openings of the recesses 62 are not shown in the drawings.

As is clearest in FIGS. 7A-7B in accordance with at least some embodiments of the present disclosure, the securing structure 14 has a hub portion 68, on which the positioning elements are provided, i.e. the recesses 62 starting from the flat surface. In accordance with at least some embodiments of the present disclosure, the hub portion 68 is connected to a surrounding portion 70 which, in accordance with at least some embodiments, is concentric thereto, which bears or otherwise bears the toothed drive elements (e.g., rotary drive elements), and which in the present embodiment takes the form of an annular portion. In accordance with at least some embodiments of the present disclosure, the connection between the hub portion 68 and the surrounding portion 70 can be provided by structure(s) 72, such as web(s), distributed around the perimeter (e.g., continuously or as discrete structures about the perimeter). This is easily achieved if the securing structure 14 is injection-molded altogether from a flexible PU-based thermoplastic (e.g. Elastollan®). In accordance with at least some embodiments of the present disclosure, the securing structures can be made from Elastollan®, for example under the material or trade names "C90/A13" and/or "C90/A55", which are available from Channel Prime Alliance, located in Des Moines, Iowa, and which are manufactured by BASF, headquartered in Ludwigshafen, Germany. Such materials can provide good compression set and high resilience, along with resistance to impacts, abrasions, tears, weather, among other qualities. Still, other materials for making the securing structures of the present disclosure are contemplated and considered within the scope of the present disclosure. Also, instead of the structure(s) described above as distributed about the perimeter, however, another structure (s) (e.g., a thin-walled resilient circumferential connecting wall) may be provided between the hub portion 68 and the surrounding portion 70 and, although not shown, such structure(s) can take the place of gap 73.

As is clear in particular from FIGS. 6A-B, 7A-B and 8, 9, the rotary drive elements are formed on the securing structure 14 and the securing structure adapter 18 by complementary toothing 74 or 76, which in the present embodiment take the form of annular toothing and which are provided and described herein in accordance with at least some embodiments of the present disclosure. This toothing 74 and 76 is, slightly conical, being convexly conical on the securing structure 14 and concavely conical on the securing structure adapter 18. In this way, the annular 74 and 76 has a centering effect upon engagement with regard to the common axis of securing structure 14 and securing structure adapter 18.

In accordance with at least some embodiments of the present disclosure, the securing structure adapter 18 has a sleeve-shaped rotationally symmetrical member 106 made of metal, e.g. brass, which is provided with a central receiving bore 108 for the shaft end 110 (FIG. 2), of appropriately conformed diameter, of the holding shaft 12. Non-rotatable connection, correct with regard to angle of rotation, of the member 106 with the shaft end 110 is effected by a cross-pin 112, which engages in a transverse bore 114 in the shaft end 110 and at the same time in a drive recess 116 in the member 106. The drive recess 116 is so tightly adapted to the cross-pin 112 that the member 106 cannot rotate relative to the holding shaft 12 after fitting of the cross-pin 112. Only one drive recess 116 is provided, such that the securing structure adapter 18 may be fitted to the holding shaft in only one position with regard to angle of rotation.

Attached to, for example injection-molded onto, the member 106, is an externally conical receiving element 118 for the securing structure 14. The receiving element 118 is or can be molded from a hard thermoplastic, for example polyoxymethylene (PM), and has a cylindrical receiving bore 120 for the hub portion 68 of the securing structure 14. The upper edge of the receiving element 118 is shaped to form the toothing 76. The receiving bore 120 ends at an inner surface 122 oriented perpendicularly to the axis of rotation D, from which surface 122 there protrude the projections 58.

In accordance with at least some embodiments of the present disclosure, the projections are located on the securing member adapter and the recesses on the securing structure.

According to another aspect of the present disclosure, the securing member may comprise a hub portion comprising the positioning elements and an outer or surrounding portion (e.g., an annular portion) connected resiliently integrally formed, integrated, or otherwise provided therewith, which bears or otherwise includes the drive elements (e.g., rotary drive elements) of the securing structure. The resilient connection, forming, integration and/or other provision between or of the surrounding portion and the hub portion allows simplified, improved adaptation of the securing structure to the shape (e.g., convexity) of the lens to be machined.

The above-mentioned connection between or formation of the hub portion and surrounding portion may be achieved in number of ways, for example, by way of a plurality of structures (e.g., webs), distributed about (e.g., evenly about) the perimeter (e.g., circumference). During injection-molding of the securing structure from a suitable thermoplastic material, the various portions and/or structures (e.g., hub portion) may be molded in one piece. By way of example, instead of individual structures, a connection (e.g., a continuous, annular, thin-walled connection) may also be provided, for example, at least partially between hub portion and surrounding portion, which connection allows similar flexible deformation between surrounding portion and hub portion for the purpose of adaptation to lens shape (e.g., convexity).

The drive elements on the securing structure and on the securing structure adapter are constructed, as complementary toothing or toothed portions. This toothing has the effect of centering a securing structure and securing structure adapter due to the radial tooth orientation thereof optionally together with a complementary conical construction of the toothing.

Figure 11:
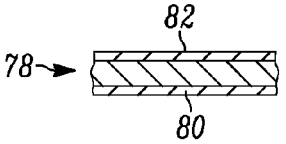
FIG. 11 is a schematic, broken-away cross-sectional view of the adhesive film portion according to FIG. 10 on a very enlarged scale, in accordance with at least some embodiments of the present disclosure.

The securing structure 14 may be attached to lens L by way of an adhesive film portion 78 having an adhesive on both sides. The adhesive film portion 78 serves in mounting the lens L by way of the securing structure 14 and is located after mounting and clamping between the securing structure 14 and the lens L, as is clear from FIGS. 1 and 2. A feature of the adhesive film portion 78 consists in the fact that the adhesive applied to the side 80 thereof facing the securing structure 14 has a greater adhesive power than the adhesive applied to the side 82 thereof facing the lens L (FIG. 11), whereby stronger adhesion to the lens L, which would be undesirable, is prevented.

Figure 10:
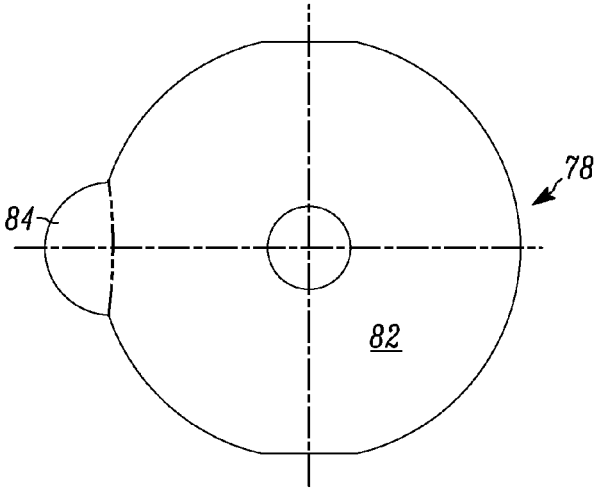
FIG. 10 is a plan view of the adhesive film portion according to FIG. 1 on an enlarged scale relative to FIG. 1, in accordance with at least some embodiments of the present disclosure.

The adhesive film portion 78 shown in FIG. 10, which has an approximately circular external contour with a diameter corresponding approximately to the external diameter of the surrounding portion 70 of the securing structure 14, is provided with a tab 84 which simplifies the removal thereof and is non-adhesive at least on the side thereof facing the lens L, such that it cannot stick to the lens L.

Figure 12:
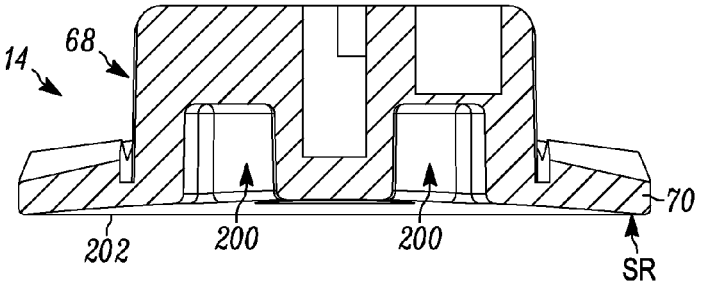
FIG. 12 is a sectional view of the securing structure along section line FIG. 12-FIG. 12 of FIG. 6B, and on a somewhat enlarged scale relative to FIG. 6B, in accordance with at least some embodiments of the present disclosure.
Figure 13:
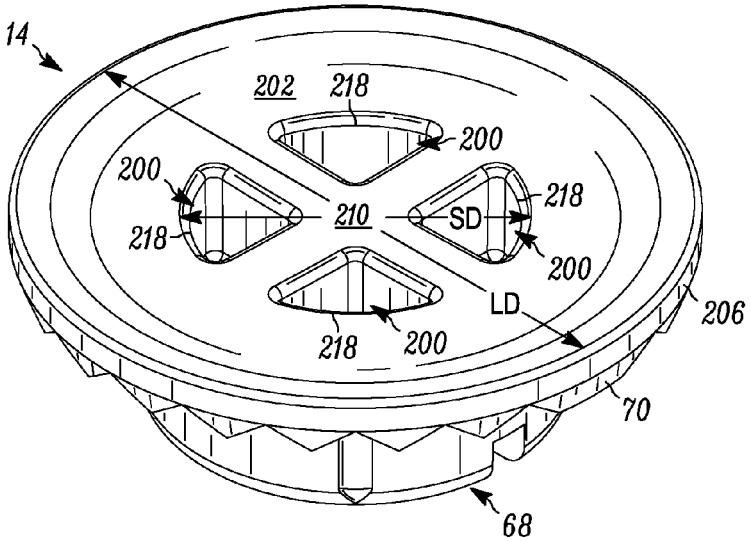
FIG. 13 is atop perspective view of the securing structure of FIGS. 6A-6B, including plurality of recess portions or structures and a rib structure, in accordance with at least some embodiments of the present disclosure.
Figure 14:
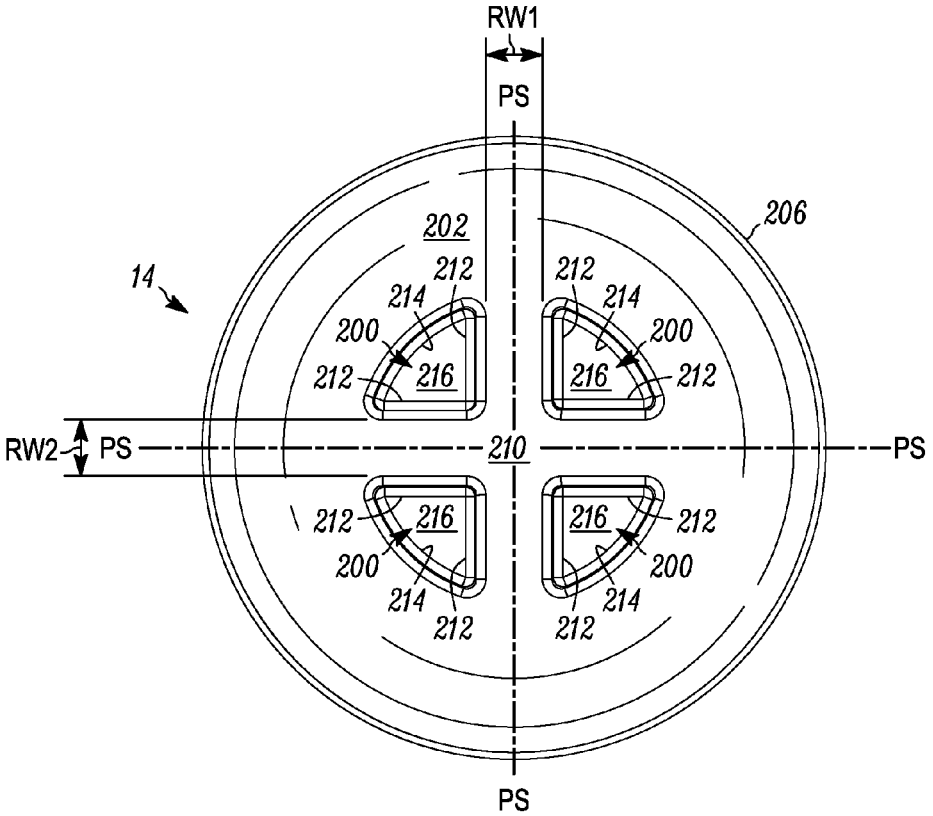
FIG. 14 is a top view of FIG. 13.

With reference to FIGS. 12-14, securing structure 14 can be seen to include a plurality of additional recesses or voids 200 (also referred to as "recess structures" or "recessed or void structures" which are open at a surface 202 for receiving an optical piece (e.g., a lens) and extend into the structure, and more particularly as shown, into the hub portion 68, which is connected to surrounding portion 70. Recesses 200 are spaced apart in a symmetric fashion and separated by, or otherwise spaced apart by, a rib structure 210. In accordance with at least some embodiments, lens-receiving surface 202 has a contour that is generally convex and a portion of the surface extends to include, so as to coincide with, a surface of the rib structure 238. In accordance with at least some embodiments of the present disclosure and as shown, each of the recesses 200 are regions that take on a shape that is partially cylindrical or at least substantially partially cylindrical (e.g. pie-shaped) and the rib structure 210 can include a plurality of portions which together can provide a cross or substantially cross-shaped form for the rib structure 210. As shown, each of the respective partially cylindrical recesses 200 comprises a region bounded on its sides by a pair of flat or substantially flat surfaces or walls 212, along with an arcuate (e.g., cylindrical) or contoured surface or wall 214, and further bounded at a respective base or interior-most contoured surface 218 (again while opening at the lens-receiving surface 202). Recess contoured surfaces 216 are further included, in at least some embodiments, and join the respective flat and arcuate side surfaces with the top surface 202. In accordance with at least some embodiments of the present disclosure, rib structure 210 is formed during manufacture of the securing structure 14 (e.g., molded) and constituent rib structure portions can be viewed to intersect one another, and further, to separate respective recesses 200 from one another. Securing structure 14 also includes a contoured edge or surface 206 adjacent or on top surface 202. In accordance with at least some embodiments, edge or surface 206 comprises a convex shape. In at least one aspect and by way of non-limiting example, the recess-rib configuration of the present embodiment can be said to create a "cross support system" which allows for true and complete center support to all, or virtually all, lens sizes (e.g., radiuses), during lens edging or finishing.

Figure 15:
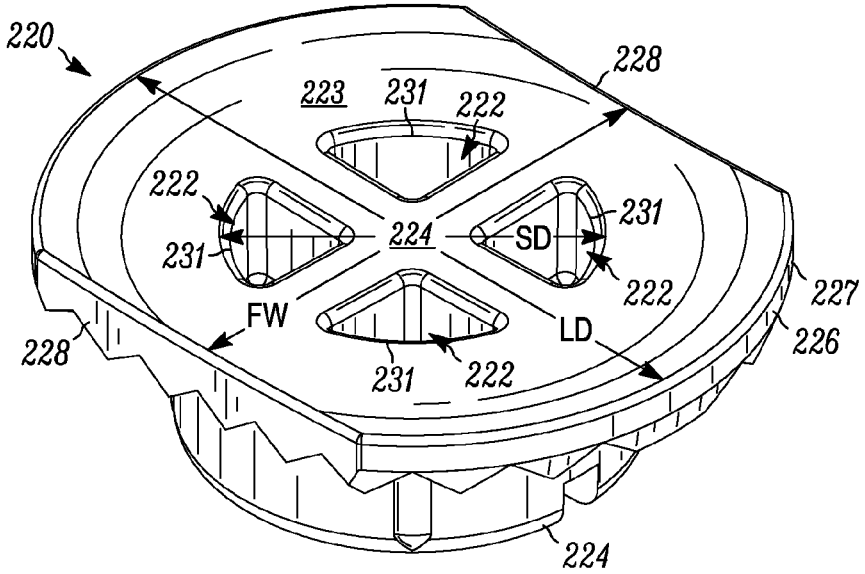
FIG. 15 is a top perspective view of another securing structure, again including plurality of recess portions or structures and a rib structure in accordance with at least some embodiments of the present disclosure.
Figure 16:
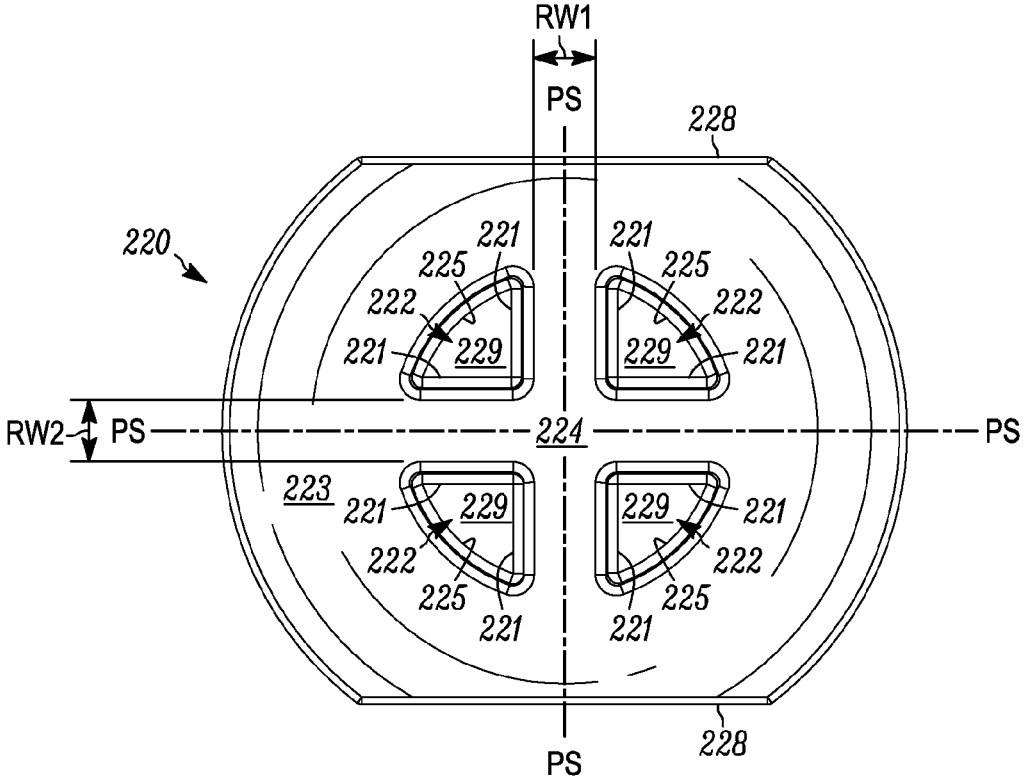
FIG. 16 is a top view of FIG. 15.

Referring to FIGS. 15 and 16, perspective and top views of another securing structure 220 are shown in accordance with at least some embodiments of the present disclosure. Securing structure 220 is similar to structure 14 described above and so many of its details (e.g., details regarding a manner of using the securing structure in conjunction with a finishing apparatus) are not provided further here. For example, securing structure 220 again includes plurality of recess structures or voids 222 which are open to a surface 223 for receiving an optical piece (e.g., a lens), as well as a rib structure 224, which includes rib structure portions (again by way of non-limiting example). Recesses 222 are spaced apart, again in a symmetric fashion. In accordance with at least some embodiments, lens-receiving surface 223 has a contour that is generally convex and a portion of the surface extends to include, so as to coincide with, a surface of the rib structure 224. In alternative embodiments, the lens or other optic piece receiving surface can have a shape that is concave, or still further, the shape can include a portion that is convex and additionally include a portion that is concave. Recess structures 222 again comprise a shape that is partially cylindrical or at least substantially partially cylindrical and rib structure 224 includes a plurality of portions that provide across or substantially cross-shaped form. As shown, each of the respective partially cylindrical recesses 222 comprise a region bounded on its sides by a pair of flat or substantially flat side surfaces or walls 221, along with arcuate or contoured (e.g., cylindrical) side surface 225, and further bounded at a respective base or interior-most contoured surface 229. Recess contoured surfaces 231 are further included, in at least some embodiments, and join the respective flat and arcuate side surfaces with the top surface of the securing structure. Rib structure 224 is formed (e.g., during molding) and separates respective recesses 234 from one another. Securing structure 220 again includes a hub portion 224 and a surrounding portion 226. Securing structure 220 also includes a contoured or "soft" edge or surface 227 adjacent or on top surface 223 which, it has been found, can serve to reduce damage to lens during edging. In accordance with at least some embodiments, edge or surface 227 comprises a convex shape. Surrounding portion 226 includes two, opposing flat (or at least substantially flat) surfaces or edges 228, which are used to accommodate a lens that has a similar shape. In at least one aspect and by way of non-limiting example, the recess-rib configuration of the present embodiment can be said to create a "cross support system" which allows for true and complete center support to all, or virtually all, lens sizes (e.g., radiuses), during lens edging or finishing.

With reference to FIGS. 12-14, securing structure 14 can be seen to include a plurality of additional recesses or voids 200 (also referred to as "recess structures" or "recessed or void structures" which are open at a surface 202 for receiving an optical piece (e.g., a lens) and extend into the structure, and more particularly as shown, into the hub portion 68, which is connected to surrounding portion 70. Recesses 200 are spaced apart in a symmetric fashion and. separated by, or otherwise spaced apart by, a rib structure 210. In accordance with at least some embodiments, lens-receiving surface 202 has a contour that is generally concave (as shown in FIG. 12) or convex and a portion of the surface extends to include, so as to coincide with, a surface of the rib structure 238. In accordance with at least some embodiments of the present disclosure and as shown, each of the recesses 200 are regions that take on a shape that is partially cylindrical or at least substantially partially cylindrical (e.g. pie-shaped) and the rib structure 2.10 can include a plurality of portions which together can provide a cross or substantially cross-shaped form for the rib structure 210. As shown, each of the respective partially cylindrical recesses 200 comprises a region bounded on its sides by a pair of flat or substantially flat surfaces or walls 212, along with an arcuate (e.g., cylindrical) or contoured surface or wall 214, and further bounded at a respective base or interior-most contoured surface 218 (again while opening at the lens-receiving surface 202). Recess contoured surfaces 216 are further included, in at least some embodiments, and join the respective flat and arcuate side surfaces with the top surface 202. In accordance with at least some embodiments of the present disclosure, rib structure 210 is formed during manufacture of the securing structure 14 (e.g., molded) and constituent rib structure portions can be viewed to intersect one another, and further, to separate respective recesses 200 from one another. Securing structure 14 also includes a contoured edge or surface 206 adjacent or on top surface 202. In accordance with at least some embodiments, edge or surface 206 comprises a convex shape. In at least one aspect and by way of non-limiting example, the recess-rib configuration of the present embodiment can be said to create a "cross support system" which allows for true and complete center support to all, or virtually all, lens sizes (e.g., radiuses), during lens edging or finishing.

Referring to FIGS. 15 and 16, perspective and top views of another securing structure 220 are shown in accordance with at least some embodiments of the present disclosure. Securing structure 220 is similar to structure 14 described above and so many of its details (e.g., details regarding a manner of using the securing structure in conjunction with a finishing apparatus) are not provided further here. For example, securing structure 220 again includes plurality of recess structures or voids 222 which are open to a surface 223 for receiving an optical piece (e.g., a lens), as well as a rib structure 224, which includes rib structure portions (again by way of non-limiting example). Recesses 222 are spaced apart, again in a symmetric fashion. In accordance with at least some embodiments, lens-receiving surface 223 has a. contour that is generally concave (as shown in FIG. 15) or convex and a portion of the surface extends to include, so as to coincide with, a surface of the rib structure 224. In alternative embodiments, the lens or other optic piece receiving surface can have a shape that is concave, or still further, the shape can include a portion that is convex and additionally include a portion that is concave. Recess structures 222 again comprise a shape that is partially cylindrical or at least substantially partially cylindrical and rib structure 224 includes a plurality of portions that provide across or substantially cross-shaped form. As shown, each of the respective partially cylindrical recesses 222 comprise a region bounded on its sides by a pair of flat or substantially flat side surfaces or walls 221, along with arcuate or contoured (e.g., cylindrical) side surface 225, and further bounded at a respective base or interior-most contoured surface 229. Recess contoured surfaces 231 are further included, in at least some embodiments, and join the respective flat and arcuate side surfaces with the top surface of the securing structure. Rib structure 224 is formed (e.g., during molding) and separates respective recesses 234 from one another. Securing structure 220 again includes a hub portion 224 and a surrounding portion 226. Securing structure 220 also includes a contoured or "soft" edge or surface 227 adjacent or on top surface 223 which, it has been found, can serve to reduce damage to lens during edging. In accordance with at least some embodiments, edge or surface 227 comprises a convex shape. Surrounding portion 226 includes two, opposing flat (or at least substantially flat) surfaces or edges 228, which are used to accommodate a. lens that has a similar shape. In at least one aspect and by way of non-limiting example, the recess-rib configuration of the present embodiment can be said to create a "cross support system" which allows for true and complete center support to all, or virtually all, lens sizes (e.g., radiuses), during lens edging or finishing.

Figure 17:
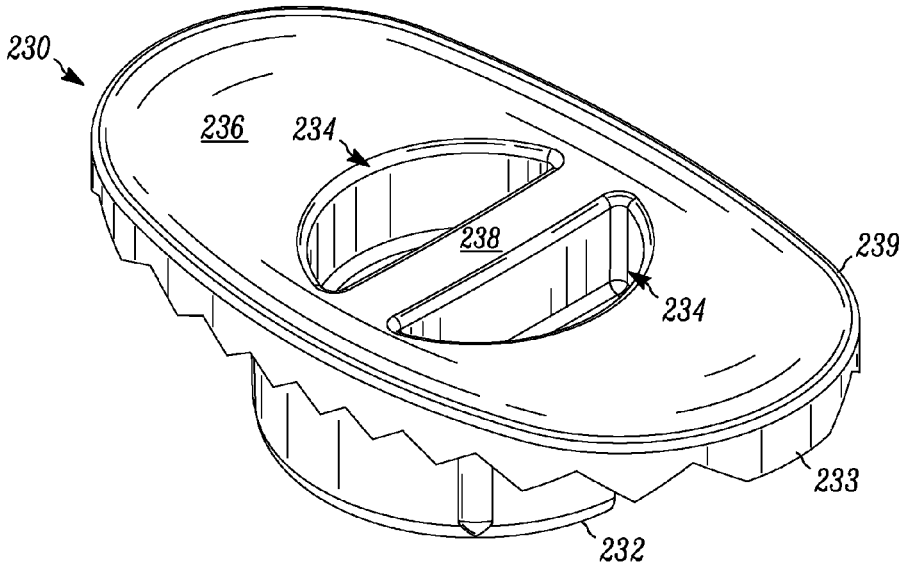
FIG. 17 is a top perspective view of another securing structure, again including plurality of recess portions or structures and a rib structure, in accordance with at least some embodiments of the present disclosure.
Figure 18:
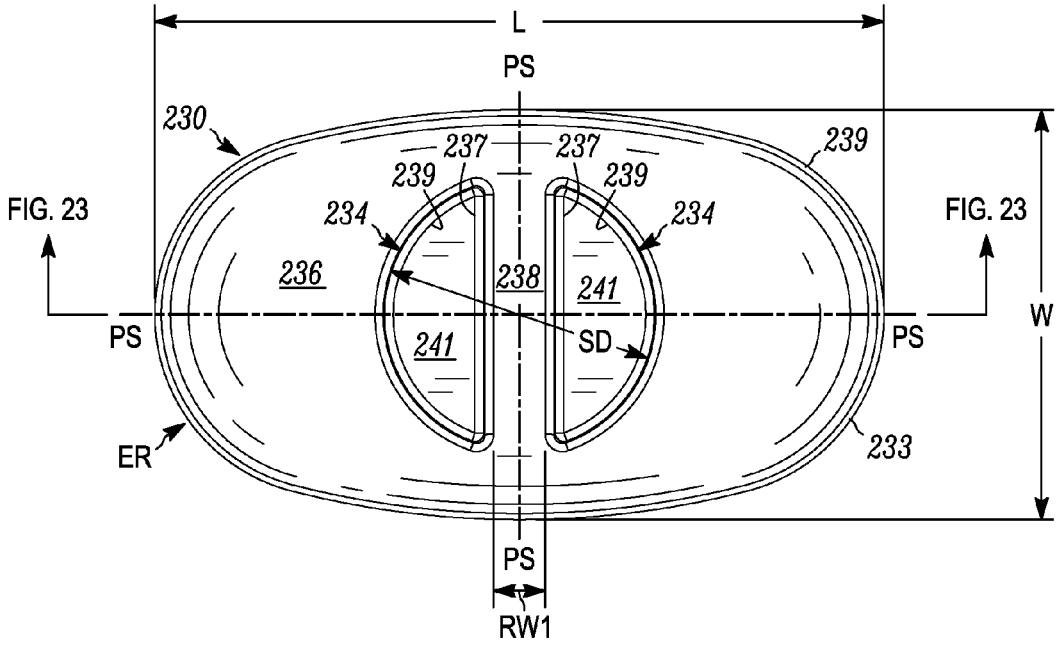
FIG. 18 is a top view of FIG. 17.
Figure 23:
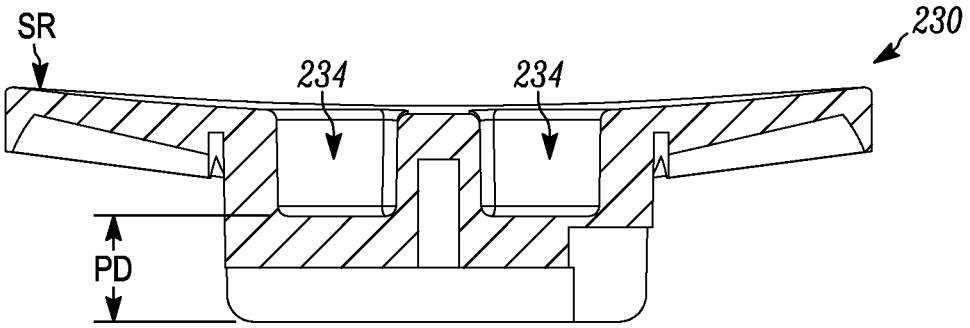
FIG. 23 is a sectional view of the securing structure along section line FIG. 23-FIG. 23 of FIG. 18, in accordance with at least some embodiments of the present disclosure.

FIGS. 17 and 18 are top perspective and top views, respectively, of another securing structure 230, in accordance with at least some embodiments of the present disclosure. Securing structure 230 is similar to structure 14 described above and so many of its details (e.g., details regarding a manner of using the securing structure in conjunction with a finishing apparatus) are not provided further here. Securing structure 230 again includes a hub portion 232 and a surrounding portion 233. Surrounding portion 233 takes a generally oblong shape. Securing structure 230 again includes plurality of recess structures or voids 234 which are open to a surface 236 for receiving an optical piece (e.g., a lens), as well as a rib structure 238, which as shown, generally includes only a single rib portion (again by way of non-limiting example). In accordance with at least some embodiments, lens-receiving surface 236 has a contour that is generally concave (as shown in FIG, 17) or convex and a portion of the surface extends to include, and so as to coincide with, a surface of the rib structure 238. Recess structures 234 take a partially cylindrical shape, or at least partially substantially cylindrical shape. More particularly and in accordance with at least some embodiments, each of the recess structures, is semi-cylindrical, or at least substantially semi-cylindrical, in shape (or a semi-circular in shape when viewed from the top view shown in FIG. 18). As shown, each of the respective recesses comprises a region bounded on its sides by a flat or substantially flat surface or wall 237, along with an arcuate or contoured (e.g., cylindrical) surface or wall 239, and further bounded at a respective base or interior-most contoured surface 241. FIG. 23 is a sectional view of the securing structure 230 along section line FIG. 23-FIG. 23 of FIG. 18, in accordance with at least some embodiments of the present disclosure and illustrating recess structures 234. Rib structure 238 again is formed (e.g., during molding) and can serve to separate respective recesses 234 from one another. Securing structure 230 also includes a contoured or "soft" edge or surface 239 adjacent or on top surface 236 which, it has been found, can serve to reduce damage to lens during edging. In accordance with at least some embodiments, edge or surface 239 comprises a convex shape. In at least one aspect and by way of non-limiting example, the recess-rib configuration of the present embodiment can be said to create a "single support" member or system that offers true center support, while also allowing for the length of the securing structure to conform to all, or virtually all, lens surfaces.

Figure 19:
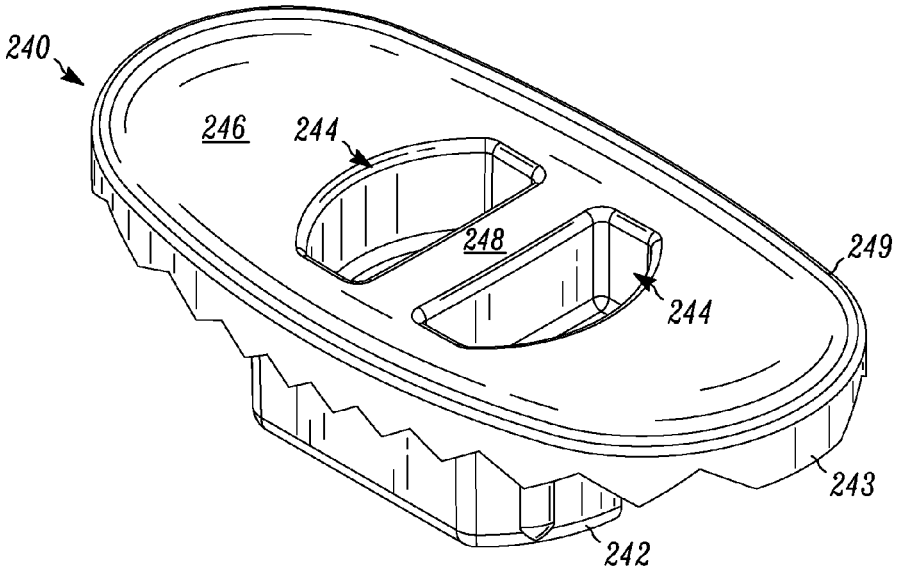
FIG. 19 is a top perspective view of another securing structure, again including plurality of recess portions or structures and a rib structure, in accordance with at least some embodiments of the present disclosure.
Figure 20:
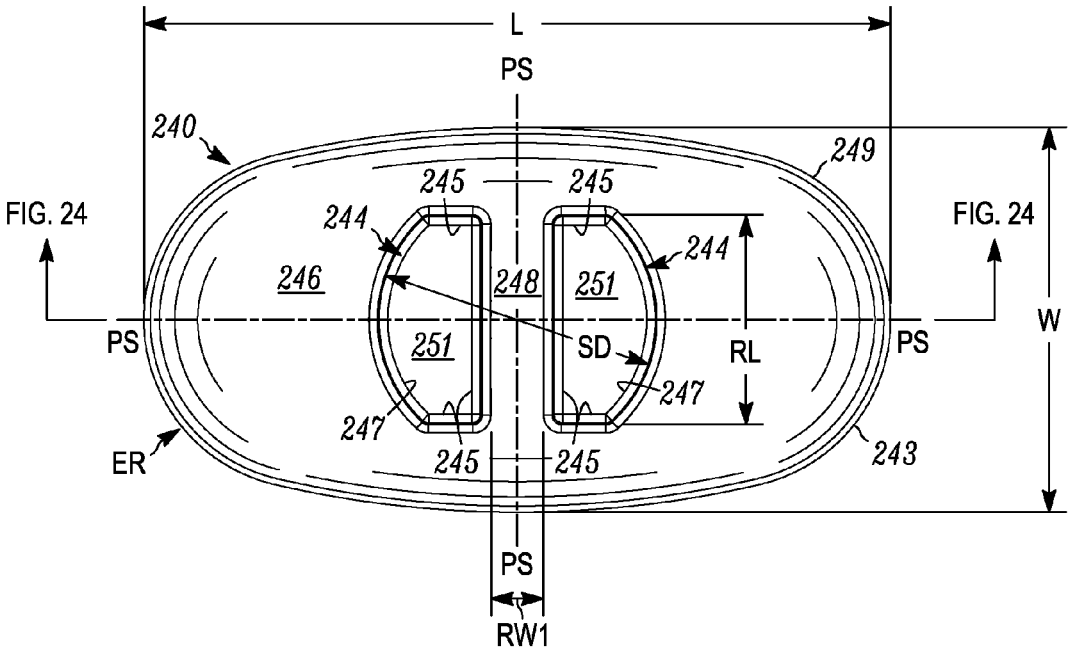
FIG. 20 is a top view of FIG. 19.
Figure 21:
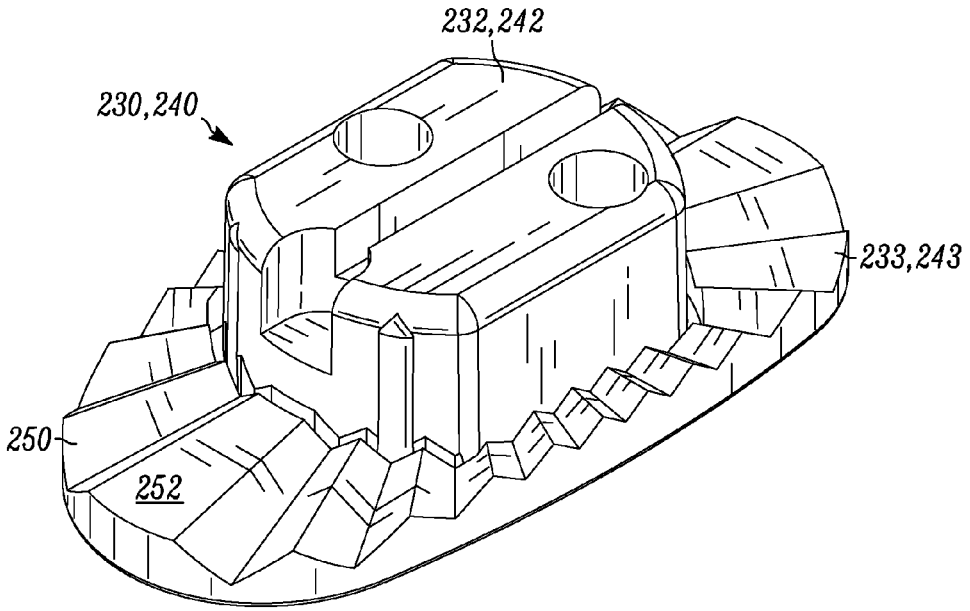
FIGS. 21-22 are a bottom perspective view and a view from below (or a bottom view), respectively, of the securing structure shown in FIG. 17 and/or FIG. 19 (with the understanding that there is some allowance for a difference in overall aspect ratios or dimensions, such as height or width, of the respective securing structures due to, for example, variations in the lens that is ultimately to be finished using the securing structures), and each on a somewhat enlarged scale relative to FIGS. 17 and/or 19, in accordance with at least some embodiments of the present disclosure.
Figure 22:
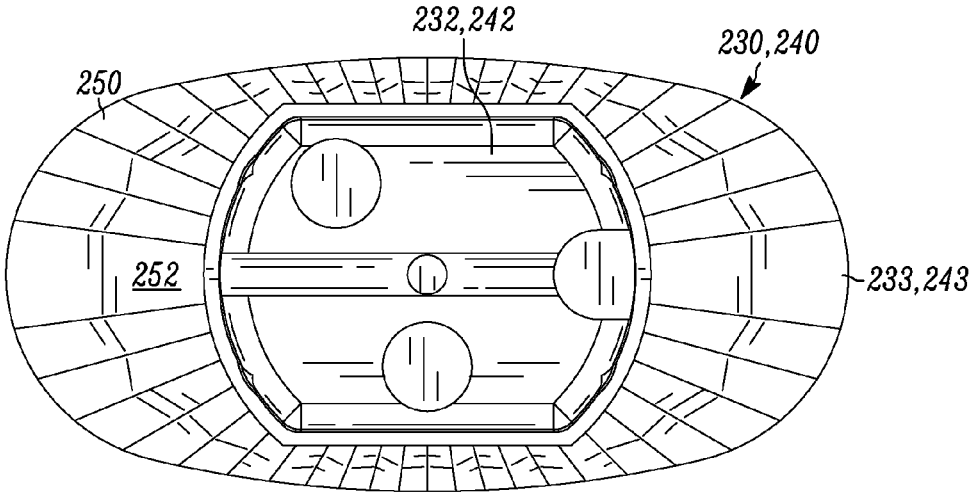
Figure 24:
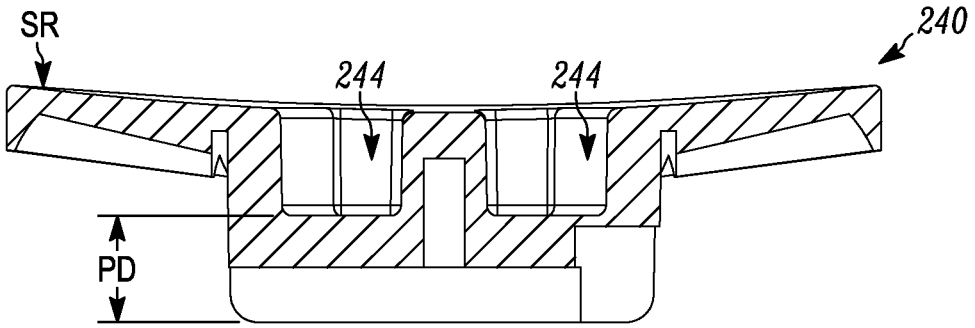
FIG. 24 is a sectional view of the securing structure along section line FIG. 24-FIG. 24 of FIG. 20, in accordance with at least some embodiments of the present disclosure.

FIGS. 19 and 20 are top perspective and top views, respectively, of another securing structure 240, in accordance with at least some embodiments of the present disclosure. Securing structure 230 is similar to structures 14 and 220 described above and so many of its details are not provided further here. Securing structure 240 again includes a hub portion 242 and a surrounding portion 243, which again is of a generally oblong shape. Securing structure 240 again includes plurality of recess structures or voids 244 which are open to a surface 246 for receiving an optical piece (e.g., a lens), as well as a rib structure 248, which as shown, generally includes only a single rib portion (again by way of non-limiting example). In accordance with at least some embodiments, lens-receiving surface 246 has a. contour that is generally concave (as shown in FIG. 19) or convex extends to include, and so as to coincide with, a surface of the rib structure 248. Recess structures 244 each comprise a region that is similar to the recess structures 234 of FIGS. 17 and 18 in as much as the regions generally include a partially cylindrical shape, or at least a substantially partially cylindrical shape. More particularly, the recess structures 244 are bounded by fiat or substantially flat side surfaces 245 *a-c*, an arcuate or contoured (e.g., cylindrical) surface 247, as well as further bounded at a respective base or interior-most contoured surface 249. FIG. 24 is a sectional view of the securing structure 240 along section line FIG. 24-FIG. 24 of FIG. 20, in accordance with at least some embodiments of the present disclosure, and illustrating recess structures 244. Rib structure 248 again is formed (e.g., during molding) and can serve to separate respective recesses 244 from one another. Securing structure 240 also includes a contoured edge or surface 251 adjacent or on top surface 246, which, it has been found, can serve to reduce damage to lens during edging. In accordance with at least some embodiments, edge or surface 249 comprises a convex shape. In at least one aspect and by way of non-limiting example, the recess-rib configuration of the present embodiment can be said to create a "single support" member or system that offers true center support, while also allowing for the length of the securing structure to conform to all, or virtually all, lens surfaces.

Exemplary dimensions are provided in the tables below with respect to the exemplary securing structures illustrated in the Figures and described above in accordance with at least some embodiments of the present disclosure. The exemplary dimensions provided include: (1) a first larger or major diameter "LD" corresponding generally to a circular region or perimeter of a respective securing structure, such as a respective surrounding portion, or a portion of a respective surrounding portion; (2) a second or smaller diameter "SD" corresponding at least generally to a circular region or perimeter of a respective securing structure, such as a respective portion that includes a plurality of recess structures and which can correspond to, for example, a distance separating arcuate (e.g., cylindrical) walls of opposite, symmetrically disposed, recess structures; (3) a first rib structure width "RW1" corresponding at least generally to a width of a rib structure or a portion of the rib structure; (4) a second rib structure width "RW2" corresponding at least generally to a width of a rib structure or a portion of the rib structure, including particularly when the rib structure includes a first rib structure width "RW1"; (5) a recess structure depth, or recess depth, "RD" corresponding to a depth of a respective recess structure, which, for purposes of the drawings, such depth is measured from an outer surface of a respective hub portion (a side opposite a respective optical piece receiving surface) of a respective securing structure to a respective innermost surface of a respective recess structure; (6) a spherical radius "SR" corresponding at least generally to a curvature (e.g., convexity) of a surface, such as the optical piece receiving surface, with such surface itself at least generally considered as coinciding with a surface of an imaginary sphere of having a radius equal to the respective spherical radius; (7) a flat side width "FW" corresponding at least generally to a width of a flat or substantially flat sided, or straight or substantially straight sided, region of a respective securing structure, such as a respective surrounding portion, or a portion of a respective surrounding portion; (8) a length "L" corresponding at least generally to a length of a region of a respective securing structure, such as a respective surrounding portion, or a portion of a respective surrounding portion; (9) a width "W" corresponding at least generally to a width of a region of a respective securing structure, such as a respective surrounding portion; and (10) an end radius "ER" corresponding at least generally to a curvature of an edge or end of a surface, such an end or an edge of a respective optical piece receiving surface, with such end or edge itself at least generally coinciding with a surface of an imaginary circle of having a radius equal to the respective end radius; and (11) a rib structure length "RL" corresponding at least generally to a length of a rib structure, or a portion of the rib structure.

Representative Dimensions for Securing Structure of FIGS. 7A-7B, 12, 13 and 14

| DIMEN-SION | DESCRIPTION | METRIC(mm) |
|---|---|---|
| 1 | FIRST OR LARGER DIAMETER (LD) | 12.5 |
| 2 | SECOND OR SMALLER DIAMETER (SD) | 6 |
| 3 | FIRST RIB STRUCTURE WIDTH (RW1) | 1.5 |
| 4 | SECOND RIB STRUCTURE WIDTH (RW2) | 1.5 |
| 5 | RECESS STRUCTURE DEPTH (RD) | 1.95 |
| 6 | SPHERICAL RADIUS (SR) | 62.5 |

Representative Dimensions for Securing Structure of FIGS. 15 and 16

| DIMEN-SION | DESCRIPTION | METRIC(mm) |
|---|---|---|
| 1 | FIRST OR LARGER DIAMETER (LD) | 12.5 |
| 2 | SECOND OR SMALLER DIAMETER (SD) | 6 |
| 3 | FIRST RIB STRUCTURE WIDTH (RW1) | 1.5 |
| 4 | SECOND RIB STRUCTURE WIDTH (RW2) | 1.5 |
| 5 | RECESS STRUCTURE DEPTH (RD) | 1.95 |
| 6 | SPHERICAL RADIUS (SR) | 62.5 |
| 7 | FLAT SIDE WIDTH (FW) | 10 |

Representative Dimensions for Securing Structure of FIGS. 17, 18, and 23

| DIMEN-SION | DESCRIPTION | METRIC(mm) |
|---|---|---|
| 1 | LENGTH (L) | 16 |
| 2 | WIDTH (W) | 9 |
| 3 | SMALLER DIAMETER (SD) | 6 |
| 4 | RIB STRUCTURE WIDTH (RW1) | 1.5 |
| 5 | RECESS STRUCTURE DEPTH (RD) | 1.95 |
| 6 | SPHERICAL RADIUS (SR) | 62.5 |
| 7 | END RADIUS (ER) | 4 |

Representative Dimensions for Securing Structure of FIGS. 19, 20 and 24

| DIMEN-SION | DESCRIPTION | METRIC (mm) |
|---|---|---|
| 1 | LENGTH (L) | 16 |
| 2 | WIDTH (W) | 8.25 |
| 3 | SMALLER DIAMETER (SD) | 6 |
| 4 | RIB STRUCTURE WIDTH (RW1) | 1.5 |
| 5 | RIB STRUCTURE LENGTH (RL) | 4.5 |
| 6 | RECESS STRUCTURE DEPTH (RD) | 1.95 |
| 7 | SPHERICAL RADIUS (SR) | 62.5 |
| 8 | END RADIUS (ER) | 3.625 |

The aforementioned dimensions are intended to be exemplary and not limiting. It is understood that one or more of the dimensions may vary to convenience and that the securing structures of the kind disclosed herein can be sized in accordance with a wide number of factors, including the type or size of lens to be machined, the particular machining apparatus in which the securing structure is utilized, among others, The aforementioned recess structures or recesses disclosed herein can advantageously provide a better form accuracy due to a more even wall thickness of the molded part, resulting in reduced variation from one part to another during manufacture. In addition, it has been found that: a) respective lens contacting surface is increased by of rib structures (including rib structure portions) during edging or finishing of the lens L, resulting in increased adhesion during edging; b) the recess structures or recesses allow trapped air to escape during bonding, further resulting in a stronger adhesion of the lens (since there is little, if any, air inclusions); c) with increased adhesion, increased forces and torque can be transmitted from the lens holding shaft of the edge-machining apparatus to the lens and to resist cutting forces of the tool; d) after edge processing, first-time-fit rate increases (e.g., a spectacle lens that is finished has a increased likelihood of fitting into a desired frame) as rotation or shifting of the lens L during edge processing is reduced.

In accordance with at least one aspect of the present disclosure, a securing structure for an optical piece is disclosed which comprises: a hub portion; a surrounding portion connected to at least partially surrounding the hub portion; a plurality of recess structures formed or otherwise provided in at least one of the hub portion and the surrounding portion and which are at least partially open on at least one side; and a rib structure that at least partially separates the plurality of recess structures. In at least some embodiments, the at least one side is a lens-receiving surface and the surrounding portion includes a contoured surface or edge near and/or adjacent the lens-receiving surface.

In accordance with at least one other aspect of the present disclosure, an apparatus for securing and clamping optical lenses requiring edge-machining is disclosed and which comprises: at least one rotatable holding shaft; a securing structure positionable in relation to the at least one holding shaft, and which is detachably attached to at least one side of the optical lens; a securing structure adapter for the securing structure, which is connectable to the at least one holding shaft; and a clamping assembly connectable to the at least one holding shaft. The securing structure comprises: a hub portion; a surrounding portion connected to the hub portion; a plurality of recess structures formed or otherwise provided in at least one of the hub portion and the surrounding portion and which are at least partially open on at least one side; and a rib structure that at least partially separates the plurality of recess structures. In at least some embodiments, the at least one side is a lens-receiving surface and the surrounding portion includes a contoured surface or edge near and/or adjacent the lens-receiving surface.

Various alternatives are contemplated and considered within the scope of the present disclosure. The securing members of the kind disclosed can have many variations as already noted. In addition, and as shown, the overall shape of the securing (also called block or blocking) member can vary to some degree while maintaining overall functionality. For example, the outer edge can take a variety of forms, which can include (as has been illustrated and/or already noted), an edge or surface (e.g., an outermost edge or surface) that can be generally round, truncated (e.g., round with straight edge or surface portions), or generally oval in shape.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

I claim:

1. A securing structure for securing an optical piece during machining of the optical piece, the securing structure comprising:

a hub portion having a generally cylindrical surface and a centerline axis;

a surrounding portion connected near an end of the hub portion and having a portion that is concentric with, and which projects generally annularly outward away from, the generally cylindrical surface of hub portion;

a plurality of recess structures, formed and extending into at least one of the hub portion or the surrounding portion, are positioned at least partially generally along the centerline axis; and a rib structure that generally spans across the centerline axis of the hub portion and separates the plurality of recess structures so that they are spaced apart and distinct from one another;

wherein each of the recess structures comprises a plurality of side surfaces and an interior-most surface, with such surfaces joined to one another so as to provide bounded voids, except that such voids are at least partially open on at least one side to a generally concave surface for receiving an optical piece, and which generally concave surface generally extends across at least a portion of the hub portion and at least a portion of the surrounding portion; and wherein the rib structure includes: (i) a surface that is at least partially coincident with the generally concave surface for receiving the optical piece and (ii) at least two additional portions, each of which is at least partially coincident with a respective side of a respective one of the plurality of recess structures, the rib structure extending from the generally concave surface for receiving the optical piece to the interior-most surface.

2. The securing structure of claim 1, wherein the plurality of recess structures comprises two recess structures.

3. The securing structure of claim 2, wherein each of the two recess structures is bounded by the respective plurality of surfaces and such surfaces include either: (i) a flat or substantially flat side surface, an arcuate side surface and an interior surface; or (ii) a plurality of flat or substantially flat side surfaces, an arcuate side surface and the interior surface.

4. The securing structure of claim 2, wherein each of the two recess structures is at least substantially partially cylindrical in shape.

5. The securing structure of claim 4, wherein each of the two of recess structures are symmetrically disposed in relation to one another.

6. The securing structure of claim 5, further comprising a plurality of planes of symmetry and wherein the two recess structures are each symmetrically disposed about at least a respective one of the plurality of planes of symmetry.

7. The securing structure of claim 6, wherein the respective one the plurality of planes of symmetry at least partially coincides with at least a portion of the rib structure.

8. The securing structure of claim 7, wherein the respective one of the plurality of planes of symmetry bisects or at least substantially bisects the at least a portion of the rib structure.

9. The securing structure of claim 5, further comprising a plurality of planes of symmetry and wherein the two recess structures are symmetrically disposed about the plurality of planes of symmetry, and wherein one of respective plurality of planes of symmetry at least substantially bisects at least a portion of the rib structure and wherein another of the plurality of planes of symmetry at least substantially bisects each of the two recess structures.

10. The securing structure of claim 9, wherein the two recess structures are configured to allow air held within the recess structures to escape during bonding of the securing structure to the optical device, thereby increasing adhesion of the securing structure to the optical piece during optical piece machining.

11. The securing structure of claim 10, wherein the surrounding portion is at least one of integrated, provided or integrally formed with respect to the hub portion in a resilient manner.

12. The securing structure of claim 11, wherein the surrounding portion includes a plurality of drive elements.

13. The securing structure of claim 12, wherein the hub portion and the surrounding portion are configured to permit flexible deformation between surrounding portion and hub portion so as to permit adaptation of the securing member to a shape of the optic piece.

14. The securing structure of claim 1, wherein the plurality of recess structures comprises four recess structures.

15. The securing structure of claim 14, wherein each of the tour recess structures is bounded by the respective plurality of surfaces and such surfaces include a plurality of flat or substantially flat side surfaces, an arcuate side surface and the interior surface.

16. The securing structure of claim 14, wherein each of the four recess structures is at least substantially partially cylindrical in shape.

17. The securing structure of claim 16, wherein each of the four recess structures are symmetrically disposed in relation to one another.

18. The securing structure of claim 17, further comprising a plurality of planes of symmetry and wherein the four recess structures are symmetrically disposed about at least a respective one of the plurality of planes of symmetry.

19. The securing structure of claim 18, wherein the respective one the plurality of planes of symmetry at least partially coincides with at least a portion of the rib structure.

20. The securing structure of claim 19, wherein the respective one of the plurality of planes of symmetry bisects or at least substantially bisects the at least a portion of the rib structure.

21. The securing structure of claim 17, further comprising a plurality of planes of symmetry and wherein the four recess structures are symmetrically disposed about the plurality of planes of symmetry, and wherein the rib structure includes a plurality of portions and one of the plurality of planes of symmetry at least partially coincides with at least a portion of one of the plurality of portions of the rib structure, and another of the plurality of planes of symmetry at least partially coincides with at least a portion of another of the plurality of portions of the rib structure.

22. The securing structure of claim 21, wherein the four recess structures are each configured to allow air held within the recess structures to escape during bonding of the securing structure to the optical device, thereby increasing adhesion of the securing structure to the optical piece during optical piece machining.

23. The securing structure of claim 22, wherein surrounding portion is at least one of integrated, provided or integrally formed with respect to the hub portion in a resilient manner.

24. The securing structure of claim 23, wherein the surrounding portion includes a plurality of drive elements.

25. The securing structure of claim 24, wherein the hub portion and the surrounding portion are configured to permit flexible deformation between surrounding portion and hub portion so as to permit adaptation of the securing member to a shape of the optic piece.

26. An apparatus for securing and clamping optical lenses requiring edge-machining comprising a securing structure comprising:

a hub portion having a generally cylindrical surface and a centerline axis;

a surrounding portion connected near an end of the hub portion and having a portion that is concentric with, and which projects generally annularly outward away from, the generally cylindrical surface of hub portion;

a plurality of recess structures, formed and extending into at least one of the hub portion or the surrounding portion, are positioned at least partially generally along the centerline axis; and a rib structure that generally spans across the centerline axis of the hub portion and separates the plurality of recess structures so that they are spaced apart and distinct from one another;

wherein each of the recess structures comprises a plurality of side surfaces and an interior-most surface, with such surfaces joined to one another so as to provide bounded voids, except that such voids are at least partially open on at least one side to a generally concave surface for receiving an optical piece, and which generally concave surface generally extends across at least a portion of the hub portion and at least a portion of the surrounding portion; and wherein the rib structure includes: (i) a surface that is at least partially coincident with the generally concave surface for receiving the optical piece and (ii) at least two additional portions, each of which is at least partially coincident with a respective side of a respective one of the plurality of recess structures, the rib structure extending from the generally concave surface for receiving the optical piece to the interior-most surface.

27. A securing structure for securing an optical piece during machining of the optical piece, the securing structure comprising:

a hub portion having a generally cylindrical surface and a centerline axis;

a surrounding portion connected near an end of the hub portion and having a portion that is concentric with, and which projects generally annularly outward away from, the generally cylindrical surface of hub portion;

a plurality of at least substantially partially cylindrically shaped recess structures, formed and extending into at least one of the hub portion or the surrounding portion, are positioned at least partially generally along the centerline axis; and a rib structure that generally spans across the centerline axis of the hub portion and separates the plurality of recess structures so that they are spaced apart and distinct from one another;

wherein each of the recess structures comprises a plurality of side surfaces and an interior-most surface, with such surfaces joined to one another so as to provide bounded voids, except that such voids are at least partially open on at least one side to a generally concave surface for receiving an optical piece, and which generally concave surface generally extends across at least a portion of the hub portion and at least a portion of the surrounding portion; and wherein the rib structure includes: (i) a surface that is at least partially coincident with the generally concave surface for receiving the optical piece and (ii) at least two additional portions, each of which is at least partially coincident with a respective side of a respective one of the plurality of recess structures, the rib structure extending from the generally concave surface for receiving the optical piece to the interior-most surface.

28. The securing structure of claim 27, wherein each of the two recess structures is bounded by the respective plurality of surfaces and such surfaces include either: (i) a flat or substantially flat side surface, an arcuate side surface and an interior surface; or (ii) a plurality of flat or substantially flat side surfaces, an arcuate side surface and the interior surface.

29. The securing structure of claim 27 wherein each of the plurality of recess structures are symmetrically disposed in relation to one another.

30. The securing structure of claim 27, further comprising a plurality of planes of symmetry and wherein the plurality of recess structures are symmetrically disposed about at least a respective one of the plurality of planes of symmetry.

31. The securing structure of claim 30, wherein the respective one the plurality of planes of symmetry at least partially coincides with at least a portion of the rib structure.

32. The securing structure of claim 31, wherein the respective one of the plurality of planes of symmetry bisects or at least substantially bisects the at least a portion of the rib structure.

33. The securing structure of claim 32, further comprising a plurality of planes of symmetry, wherein the rib structure includes a plurality of rib portions, and wherein the plurality of recess structures are symmetrically disposed about the plurality of planes of symmetry such that one of the plurality of planes of symmetry at least partially coincides with at least a portion of one of the plurality of portions of the rib structure, and another of the plurality of planes of symmetry at least partially coincides with at least a portion of another of the plurality of portions of the rib structure.

34. The securing structure of claim 27, wherein the recess structures are configured to allow air held within the recess structures to escape during bonding of the securing structure to the optical device, thereby increasing adhesion of the securing structure to the optical piece during optical piece machining.

35. The securing structure of claim 27, wherein the hub portion and the surrounding portion are configured to permit flexible deformation between surrounding portion and hub portion so as to permit adaptation of the securing member to a shape of the optic piece, and at least a portion of the rib structure is configured to support at least a portion of the optic piece upon such adaptation of the securing member to the shape of the optic piece.

36. The securing structure of claim 27, further comprising a first dimension at least generally corresponding to a diameter of a circular region or perimeter of a portion of the surrounding portion and a second dimension at least generally corresponding to an additional, smaller, diameter of another circular region or perimeter of another portion of the surrounding portion, and wherein the second dimension further at least generally corresponds to a distance separating opposing surfaces of the symmetrically disposed recess structures.

37. The securing structure of claim 27, further comprising a first dimension at least generally corresponding to a length of the surrounding portion, a second dimension at least generally corresponding to a width of the surrounding portion, and a third dimension at least generally corresponding to a curvature of an end of the surface for receiving the optical piece.

* * * * *